US006196785B1

(12) United States Patent
Lanciaux, Jr.

(10) Patent No.: US 6,196,785 B1
(45) Date of Patent: Mar. 6, 2001

(54) ATTACHABLE FRAME AND WHEELS FOR LIFTING AND MOVING A CONTAINER

(75) Inventor: Francis E. Lanciaux, Jr., Grand Rapids, OH (US)

(73) Assignee: Laurel Anne Lanciaux, Grand Rapids, OH (US)

( * ) Notice: Subject to any disclaimer, the term of this patent is extended or adjusted under 35 U.S.C. 154(b) by 0 days.

(21) Appl. No.: 09/378,078

(22) Filed: Aug. 20, 1999

Related U.S. Application Data

(60) Provisional application No. 60/097,468, filed on Aug. 21, 1998.

(51) Int. Cl.[7] ..... B60P 3/40

(52) U.S. Cl. ..... 414/458; 414/12

(58) Field of Search ..... 414/12, 458, 498, 414/499, 500, 450, 451, 621; 280/43.17, 43.2, 43.21, 43.22

(56) References Cited

U.S. PATENT DOCUMENTS

| | | | | |
|---|---|---|---|---|
| 3,794,196 | * | 2/1974 | Terho et al. | 414/458 |
| 4,452,555 | * | 6/1984 | Calabro | 414/458 X |
| 4,611,816 | * | 9/1986 | Traister et al. | 414/458 X |
| 4,693,660 | * | 9/1987 | LaCroix | 414/458 |
| 4,699,558 | | 10/1987 | Hagge et al. . | |
| 4,975,018 | | 12/1990 | Langenbacher et al. . | |
| 5,660,518 | | 8/1997 | Meier . | |
| 5,716,186 | | 2/1998 | Jensen et al. . | |
| 5,791,856 | * | 8/1998 | Kosonen et al. | 414/458 |
| 5,823,737 | * | 10/1998 | Cook | 414/451 X |

* cited by examiner

*Primary Examiner*—Robert P. Olszewski
*Assistant Examiner*—Gerald J. O'Connor
(74) *Attorney, Agent, or Firm*—David C. Purdue; John C. Purdue

(57) ABSTRACT

A device for lifting and moving a load having apertures in a lower portion of the load. The device comprises a frame having first and second ends and a load facing surface. First and second jaws are supported on the frame and the jaws are receivable in the apertures of a load. A jaw positioner is provided for moving the jaws towards or away from each other to a position where they lock the frame of the device to the load with the load facing surface in contact with the load. The device further comprises a first frame lifter and a connector for connecting it to the first end of the frame, and a second frame lifter and a connector for connecting it to the second end of the frame. The frame lifters comprise a wheel supported for reciprocating movement between a first position in which, when the frame lifter is connected to the frame and the frame is locked to the load, the wheel is above a surface under the load, and a second position in which the wheel engages the surface and supports the frame and the load above the surface.

9 Claims, 8 Drawing Sheets

ATTACHABLE FRAME AND WHEELS FOR LIFTING AND MOVING A CONTAINER

This application claims benefit to provisional 60/097,468 filed Aug. 21, 1998.

BACKGROUND OF THE INVENTION

1. Field of the Invention

The present invention relates generally to devices for engaging heavy or cumbersome loads, for example, rooftop heating, ventilating and air conditioning ("HVAC") units, and lifting the load off of a surface. More specifically, the invention relates to such devices which include wheels or casters, legs or support channels so that the load can be lifted, repositioned, lowered into place or secured to other objects.

2. Description of Prior Art

There is a plethora of prior art devices adapted to lift and reposition loads. Cranes, forktrucks, liftgates, carts, and scaffolding devices have all been used to reposition large loads. Generally, the most popular method is by the use of a crane. In almost every case, the prior art utilizes a means of gripping the load, lifting the load and repositioning the load, all supported by the framework and/or mass of the lifting device itself. For example, a crane includes a cable supported on an arm or a boom, means for connecting the cable to the load, and means for taking up or paying out cable as needed. The lifting of the load and repositioning of the load is completed by the mass and or framework of the lifting device. Cranes are often used to position large loads such as HVAC equipment on a roof. Coordination of delivery of HVAC equipment on a truck and the crane for lifting the load off of the truck can be difficult and often costly. If coordination of the two events do not coincide in time, a crane must be brought back to the site, at an added cost, to put the HVAC equipment into final position. Even helicopters have been used to position such equipment.

SUMMARY OF THE INVENTION

The present invention is based upon the discovery of a device which can be operated to engage an apertured rail secured to a large load, such as HVAC equipment, lift the load at one location, support the load on wheels or casters while it is moved toward a final position, and lower the load into a final position. Typically, such rails include apertures for receiving the forks of a fork lift truck or the lifting lugs of a crane. A load without apertured rails can be accommodated by the device if apertures are formed at the base of the load. A device according the present invention comprises a frame member having a rail or load face, at least one pair of jaws supported on said frame member and a jaw positioner operably connected to position the jaws in a first position, in which said jaws can be inserted into one or more openings a rail connected to a load, and operable to position the jaws in a second position, in which the jaws engage a portion of the rail and cause the rail or load face of the frame member to abut the rail or load, thereby locking the frame member to the rail or load. The device further comprises at least one wheel, caster, leg or support channel, secured on the frame member and a frame lifter operable to raise and lower the frame member relative to the wheel, caster, leg or support channel. In a preferred embodiment, the frame member has a pair of wheels or casters at opposite ends of the frame member, each including a frame lifter.

When a desired number of the devices have been secured to the load or to rails under a load, (the rails generally being an integral part of the load to be repositioned) the frame lifters are actuated to raise the frame and the rails and the load so that they are supported on the wheels or casters. The load can then be maneuvered by one or more individuals or by other mechanical means to a desired location where the frame lifters are again actuated to lower the frame members and the load into place. Once the load is in place, the jaw positioners of the devices are actuated to return the jaws to the first position so that the device may be removed from one load and secured another.

The device is portable and is small enough and light enough that it can easily be transported to a roof for lifting, supporting and repositioning large loads including HVAC units. In a preferred embodiment, the device is also assembled from a plurality of modules, so that it can be disassembled into the modules, transported, and then reassembled for use in a new location. The device also has utility in the manufacture and transportation of HVAC units or other large pieces of machinery and can be utilized to move HVAC units or other machinery from station to station in the assembly operation used in manufacturing thereof.

Accordingly, it is an object of the present invention to provide a device for lifting and repositioning a large load, especially one supported on rails or the like.

It is a further object of the invention to provide a device which can be positively locked to or unlocked from the load or a rail attached to a load.

It is a primary object of this invention to provide a device including a frame member which can be locked to a large load and including frame lifters for raising the frame member and the rail and the load and supporting the load on wheels, casters, legs or support channels that are secured to the frame member.

These and other objects and advantages over the present invention will no doubt become apparent to those skilled in the art after having read this detailed description of the invention including the following description of the preferred embodiment which is illustrated by the various figures of the drawing.

DETAILED DESCRIPTION OF THE INVENTION

Figure 1:
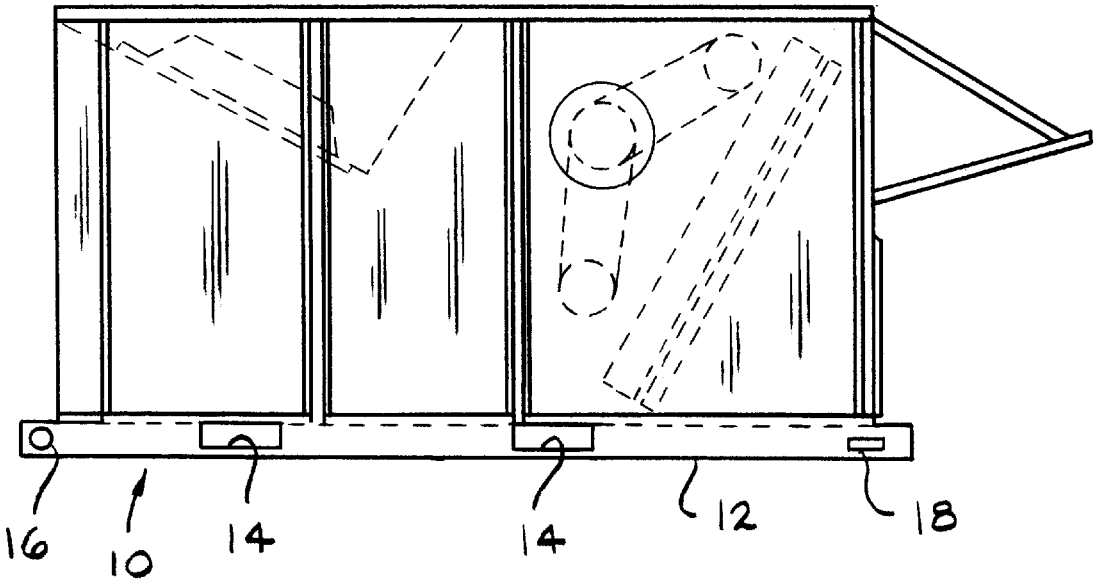
FIG. 1 (PRIOR ART)
FIG. 1 is a side view of an HVAC rooftop unit which is supported on base rails provided as an integral part of the unit and having openings for receiving a fork truck fork and openings to receive lifting lugs of a crane.

Referring to FIG. 1, a conventional, prior art air conditioning unit is indicated generally at 10. The unit is secured to and supported on a pair of rails, one of which is shown at 12, which are securely fastened to the unit 10 by fasteners (not shown). The rails 12 are provided with a pair of openings, indicated at 14, which are sized and spaced to receive the forks of a fork lift truck. Typically, such openings are about 8 inches wide, 2¼ inches high and the openings are spaced, on centers from each other, about 30 inches. Alternatively, the rails 12 might be provided with round lifting lug openings indicated at 16 or oval lifting lug openings such as the one indicated at 18. The lift of the present invention has utility in lifting and transporting any heavy load wherein the load has a pair of openings adjacent to a lower edge thereof. This could include a heavy piece of equipment or the like with a frame or housing which does not have such openings, as produced, but which is provided, afterwards, with such openings.

Figure 2:
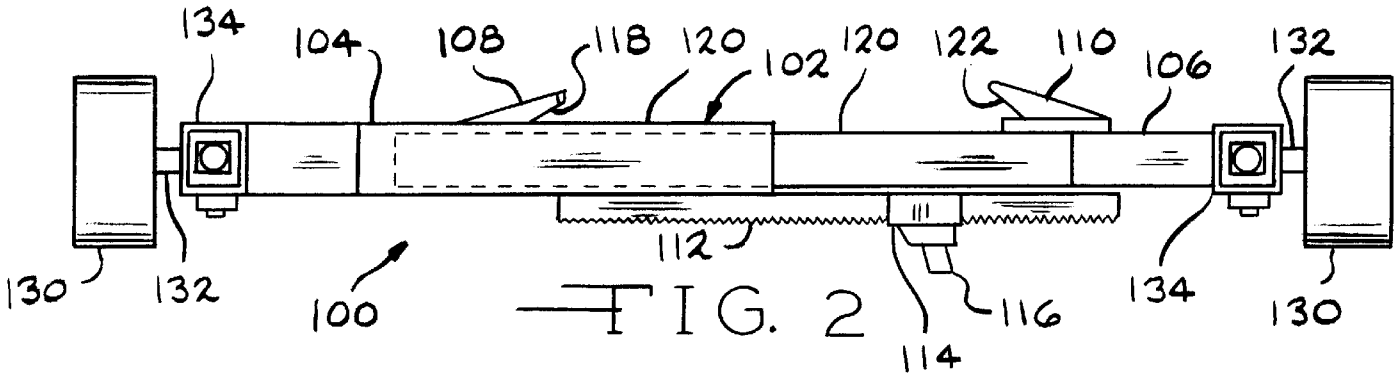
FIG. 2 is a top view of a device according to the present invention.
Figure 3:
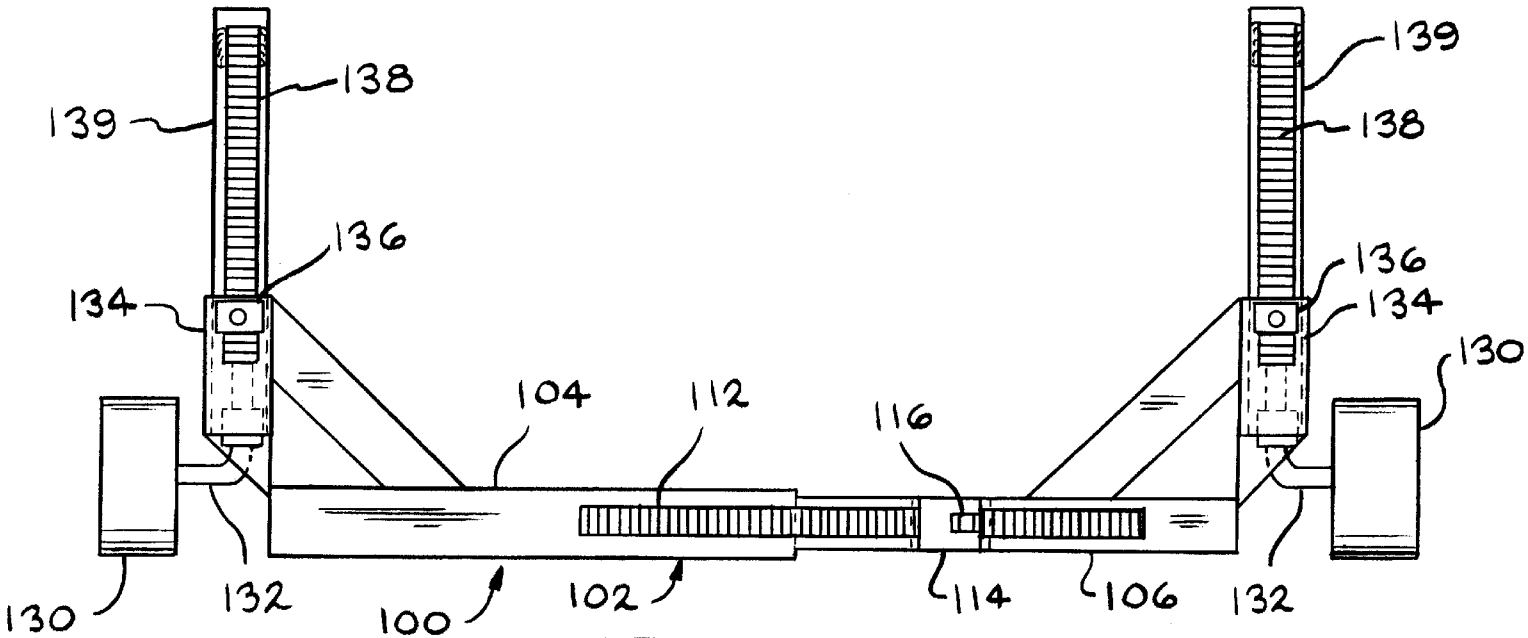
FIG. 3 is a side view of the device shown in FIG. 2

Referring now to FIGS. 2 and 3, a device according to the present invention is indicated generally at 100. The device 100 comprises a frame member 102 which, in turn, comprises an outer channel 104 and an inner channel 106 which is sized to be slideably received within the outer channel 104. A first jaw 108 is securely fastened to the outer channel 104 by suitable fasteners (not shown) or by welding, or the like. A second jaw 110 is securely fastened to the inner channel 106 in the same manner as the first jaw 108. Sliding movement between the inner channel 106 and the outer channel 104 is effected by a jaw positioner comprising a toothed spline 112, an end of which is secured to the outer channel 104, and a ratchet mechanism indicated at 114 including a lever actuator 116. The ratchet mechanism 114 is secured to the inner channel 106 so that the ratchet mechanism, through its engagement with the toothed spline 112 is operable to cause sliding movement between the inner channel 106 and the outer channel 104 and corresponding movement between the jaws 108 and 110 secured, respectively, to the outer channel 104 and the inner channel 106.

The jaws 108 and 110 extend away from the outer channel 104 and the inner channel 106, respectively. The jaw 108 has a rail or load engaging surface 118 and at least a portion of the surface 118 faces a rail or load surface 120 of the frame member 102. Similarly, the jaw 110 has a rail or load engaging surface 122 and at least a portion of the surface 122 faces the rail or load surface 120 of the frame member 102. The jaw positioner is operable to move the outer channel 104 and the jaw 108 secured to it, relative to the inner channel 106 and the jaw 110 secured to it from a first position, in which the jaws 108 and 110 can be inserted through openings 14 (FIG. 1) in a rail 12 and a second position, closer together, in which a portion of the rail 12 or load is held captive between the rail or load face 120 (FIG. 2) and the rail or load engaging surfaces 118 and 122 of the jaws 108 and 110. In the second position, the frame member 102 is held tight against the rail or load by the jaws 108 and 110. The jaws 108 and 110 may take other forms such as a rod which would preferably be angled relative to the rail or load face as are the jaws 108 and 110. Rod shaped jaws would be well suited for engaging a rail or load through lifting lug apertures 16 or 18 (FIG. 1). As indicated above, the devices of the present invention are also well suited for use with a large load which may not be provided with an apertured rail in the case where small apertures may be formed adjacent to or along a lower edge of such a load. In that case, the apertures formed and the particular jaws used should cooperate so that a rail or load face of the device can be held, by the jaws, fast and or tight against a rail or other portion of the load.

At each end of the frame member 102, there is a frame lifter comprising a wheel member 130 supported on an axle 132 which is supported in a housing 134 which, in turn, is secured to the frame member 102. A ratchet mechanism 136 is secured to the housing 134 and is operable to engage openings indicated at 138 in a channel member 139 which is secured to the axle 132. The ratchet lift mechanism 136 is operable to raise the frame member 102, relative to the wheel member 130, from the lowered position shown in FIG. 3, where the wheel is supported so that it would be above whatever surface, a roof, for example, the frame member 102 was resting on, to a raised position (not shown) where the wheel would be supported on the surface such as the roof and the frame member 102 would be elevated and supported on the wheel member 130. With a pair of devices secured to opposite sides of a load, the lift mechanism would be operated to lock the frame in the raised position so that the load, for example, an HVAC unit (not shown) can be repositioned by rolling it on the wheel members. When the frame member 102 and the load are in a desired position, the frame is returned to the lowered position and the weight of the load is removed from the wheels and returned to the surface under the load. Then, the ratchet 116 is released and the outer channel 104 and the inner channel 106 are moved apart until the frame member and the jaws 108 and 110 can be removed from the rail of the HVAC unit and the device is ready for another move.

The jaw positioner comprising the toothed spline 112 is also operable to slide the inner channel 106 out of the channel 104, so that the apparatus is composed of two components, namely, the outer channel 104 and the housing 134 attached thereto, and the inner channel 106 and the housing 134 attached thereto. Similarly, each of the ratchet lift mechanisms 136 is operable to slide the channel member 139 in the housing 134 to a position where it is no longer engaged by the latter, and the apparatus is composed of four components, namely the outer channel 104 and the housing 134 which is carried thereby, the inner channel 106 and the housing 134 which is carried thereby, and components composed of each of the wheels 130, each of the axles 132 and each of the channel members 139. The device 100 can be disassembled, for transportation, into the four components just described, and then reassembled to the state shown in FIGS. 2 and 3 for use in a new location. Each of the components is usually light enough that it can be transported by a single person.

Figure 4:
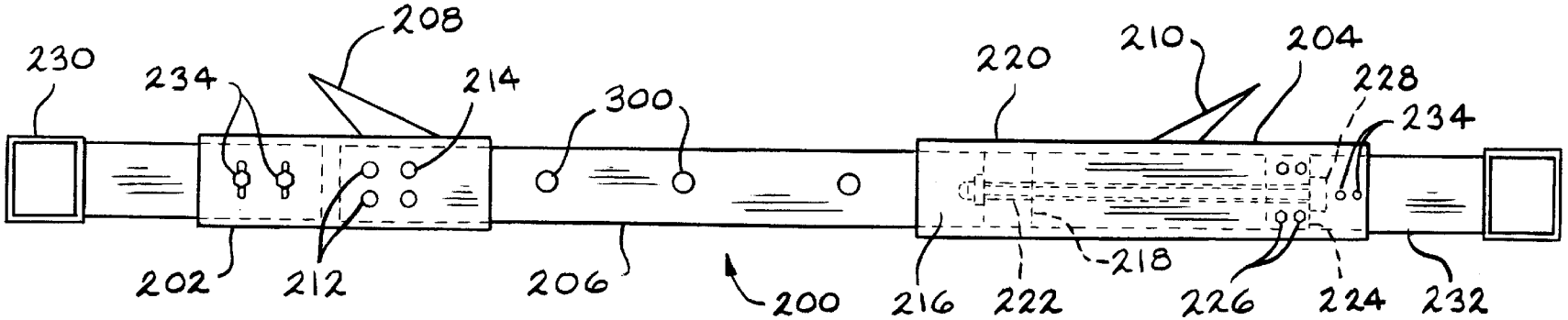
FIG. 4 is a top view of a second, preferred embodiment of a device according to the present invention

Referring now to FIG. 4, an alternative, preferred embodiment of a frame member is indicated at 200 and comprises a first, outer channel member 202, a second outer channel member 204 and an inner channel member 206 which is slideably receivable inside the outer channel members 202 and 204. A first jaw 208 is secured to the first outer channel member 202 and a second jaw 210 is secured to the second outer channel 204. One end of the inner channel member 206 is secured to the first outer channel member 202 by a pair of pins 212 which extend through apertures in both. A second set of apertures indicated at 214 may be provided in the outer channel so as to provide means for adjusting the length of the portion of the inner channel which is received in the outer channel member 202, thereby permitting an adjustment to the gross length of the frame member 200. It is preferred that a device according to the invention include a plurality of inner channel members of differing lengths to provide versatility in terms of accommodating various spacings between openings in a rail attached to a load to be repositioned with the device. The other end of the inner channel member 206 is telescopically received within the second outer channel member 204 and the relative longitudinal positions of the inner channel member 206 and the second outer channel member 204 is controlled by a jaw positioner mechanism indicated generally at 216, and shown in some detail in FIG. 5.

The jaw positioner 216 comprises a block 218 which is received in the second outer channel member 204 and engages an end 220 of the inner channel member 206. The block 218 is internally threaded to cooperate with an externally threaded screw drive shaft 222 which is supported in a second block 224 for rotation therein. Acme threads are preferred in this application. The second block 224 is secured in the second outer channel member 204, for example, by fasteners, as indicated at 226, or by welding or the like. The screw drive shaft 222 has a head 228 engageable by a socket or the like so that it may be rotated to cause relative telescopic movement between the inner channel member 206 and the second outer channel member, thereby controlling the relative positions of the jaws 208 and 210.

Figure 5:
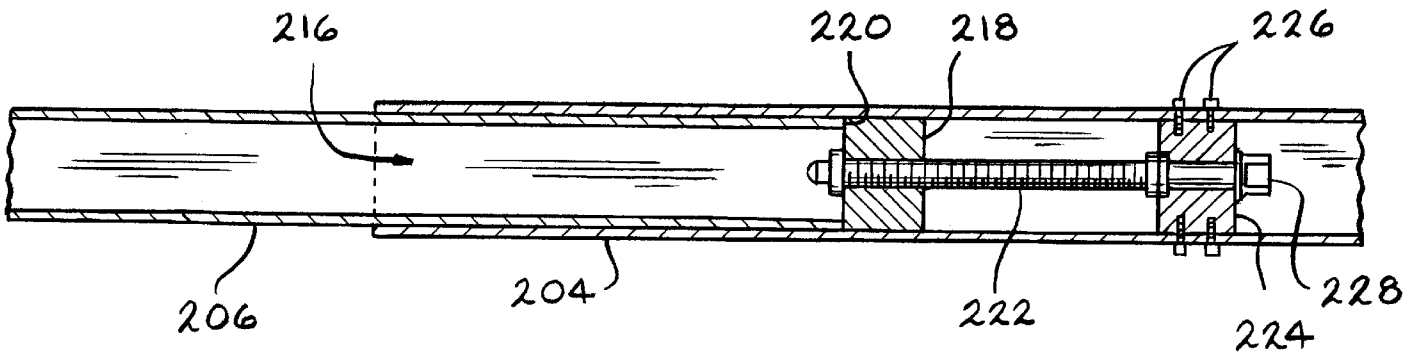
FIG. 5 is a detail view of a jaw positioner of the device shown in FIG. 4.
Figure 7:
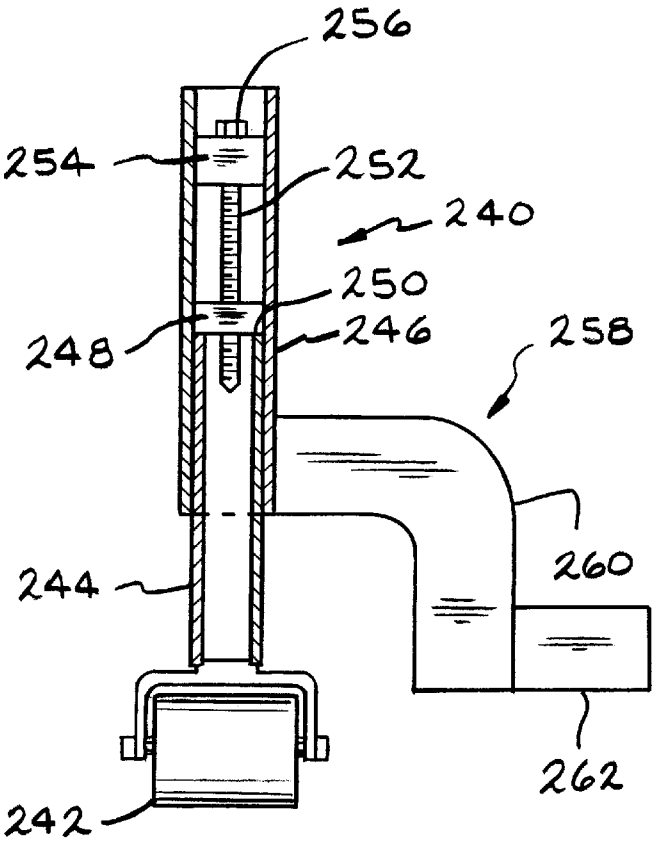
FIG. 7 is a view, partially in cross section, of a roller assembly including a frame lifter in a raised position.
Figure 6:
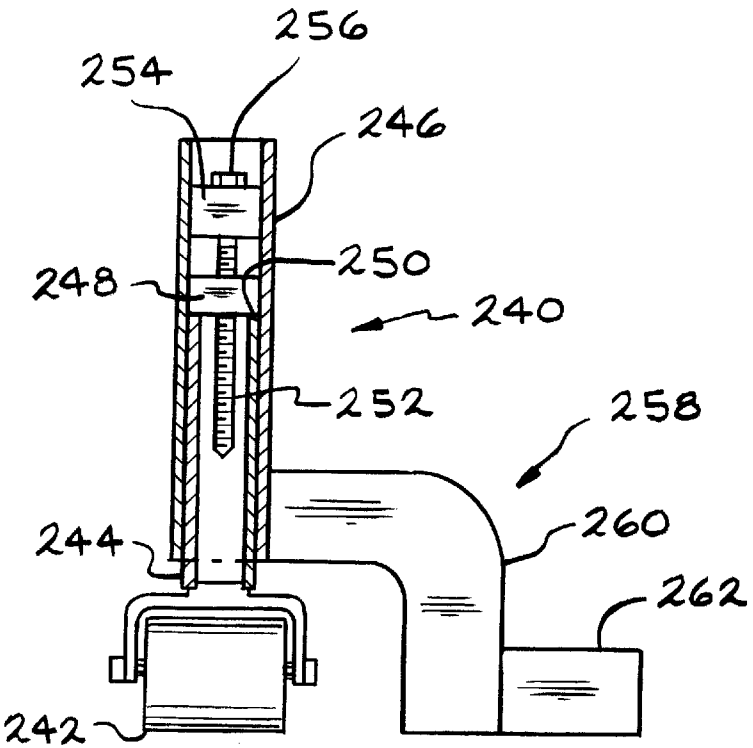
FIG. 6 is a view, partially in cross section, of a roller assembly including a frame lifter in a lowered position.

In the ends of the first and second outer channel members 202 and 204, there are connected frame lifters which comprise housings 230 and 232 for receiving and supporting wheel members (not shown in FIGS. 4 and 5; see FIGS. 6 and 7, for example). It will be appreciated that the jaw positioner mechanism illustrated in FIG. 5 can be readily utilized in a frame lifter mechanism, as illustrated in FIGS. 6 and 7 and discussed below, instead of the ratchet mechanism described above with reference to FIGS. 2 and 3. Indeed, there are numerous other mechanisms that can be utilized to effect the frame lifting function required in the present invention including, but not limited to, hydraulic and pneumatic mechanisms. The frame lifter, that is, the housings 230 and 232 are preferably telescopically received in the ends of the outer channel members 202 and 204 and connected therein by connectors such as by bolts, as indicated at 234 or other suitable fasteners, or welding. It is preferred that the frame member be separable from and connectable to the frame lifter, as shown.

Referring now to FIGS. 6 and 7, a frame lifter mechanism, corresponding generally with the jaw positioner mechanism 216 (FIGS. 4 and 5) is indicated generally at 240. A wheel member is supported on an inner channel member 244 which is received in an outer channel member 246. A thrust block 248 is sized to engage the upper end 250 of the inner channel 244 and is internally threaded to cooperate with an externally threaded screw drive shaft 252. The longitudinal position of the drive shaft 252 in the outer channel 246 is fixed through a fixed block 254 which is suitably secured to the outer channel 246 against longitudinal movement therein. Accordingly, the frame lifter mechanism is operable to lift a frame (not shown), relative to the wheel member 242, from a first, lowered position shown in FIG. 6, to a second, raised position shown in FIG. 7, upon rotation of the screw drive shaft 252 effected, for example, by rotation of a head 256. The outer channel 246 is part of a housing, indicated generally at 258, which further comprises a connector arm 260 having an end 262 adapted to be received in and secured to an end of a frame member, as described above with reference to FIGS. 4 and 5.

Figure 8:
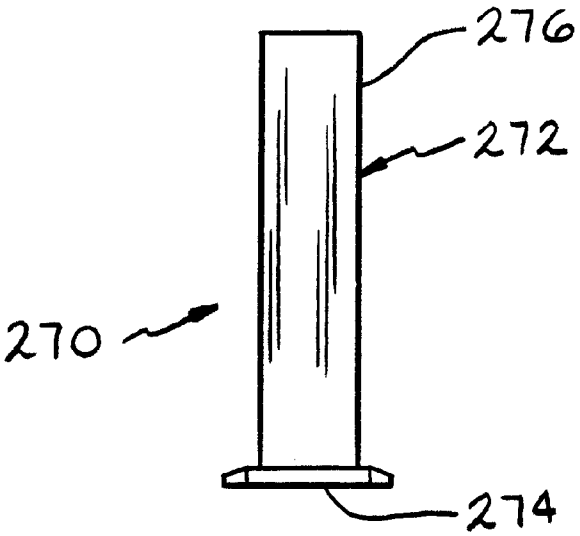
FIG. 8 is a view of a fixed leg for use in combination with the present invention.

Referring now to FIG. 8, a fixed leg useful in connection with the present invention is indicated at 270. The leg simply comprises a post 272 and a foot 274 secured to a lower end of the post 272. An upper end 276 of the post is adapted to be received, for example, in an outer channel member, such as member 246 (FIGS. 6 and 7), in a situation where an HVAC unit or other large load needs to be lifted vertically or semi-permanently positioned and supported at a height above the height it would otherwise be supported by or on a surface below it. The post 272 preferably comprises a channel member, sized to correspond with the inner channel member 244 (FIGS. 6 and 7) so it is engageable by the thrust block 248 to provide an adjustable height feature. The upper end 276 of the post 272 may be received within a channel member of a housing such as the housing 134 (FIGS. 2 and 3), a housing 230 or 232 (FIG. 4) or a housing 258 (FIGS. 6 and 7).

Figure 9:
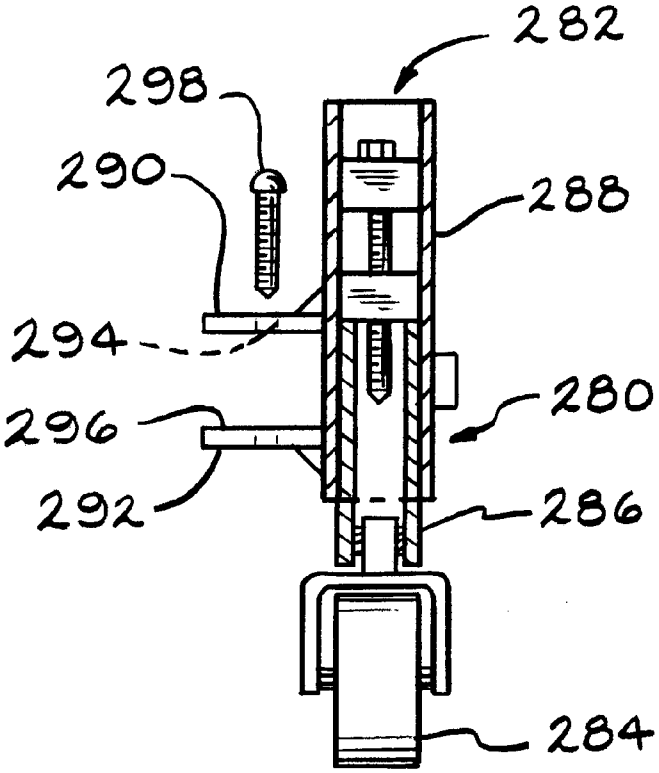
FIG. 9 is a view, partially in cross section, of an intermediate wheel assembly useful in combination with the lifting devices of the present invention.

Referring now to FIG. 9, an intermediate wheel assembly indicated generally at 280 includes a frame lifter mechanism 282 which corresponds generally with the frame lifter mechanism 240 (FIGS. 6 and 7). A wheel member 284 is supported on an inner channel 286 which, in turn, is telescopically received in an outer channel 288. The wheel assembly 280 includes an upper flange 290 and a lower flange 292 which are connected to and extend from the outer channel member 288 and these flanges are sized to fit around a portion of a frame member, i.e., above and below the frame member, such as the frame member 202 shown in FIG. 4. The flanges have aligned apertures, indicated at 294 and 296 for receiving a pin 298, for securing the intermediate wheel assembly 280 to a frame member provided, for example, with apertures 300 shown in FIG. 4. The apertures 300 are provided in the inner channel member 206 but may also be provided, if desired, in one or the other outer channel members 202 and 204. The intermediate wheel assembly 280 has utility where the jaws of a device according to the invention are spaced far apart and there is a structural need for distributing the weight of a load. The wheel assembly 280 also has utility for temporarily raising and supporting a frame member and an associated wheel member so that the device and a load supported thereon can be maneuvered over a fixed obstacle on the ground such as a conduit or a pipe. This could entail securing two devices according to the present invention to opposite sides of the base of a load, rolling the load towards a ground level obstacle until one of the wheels of the devices is adjacent to the obstacle, securing one of the intermediate wheel assemblies 280 to the frame adjacent to the wheel which is adjacent to the obstacle so that the wheel 284 supports the load, raising the wheel adjacent to the obstacle, advancing the load until the raised wheel is beyond the obstacle, lowering that wheel and continuing until all wheels of the devices have cleared the obstacle. Two or more intermediate wheel assemblies can be utilized at one time to speed up this process.

Figure 10:
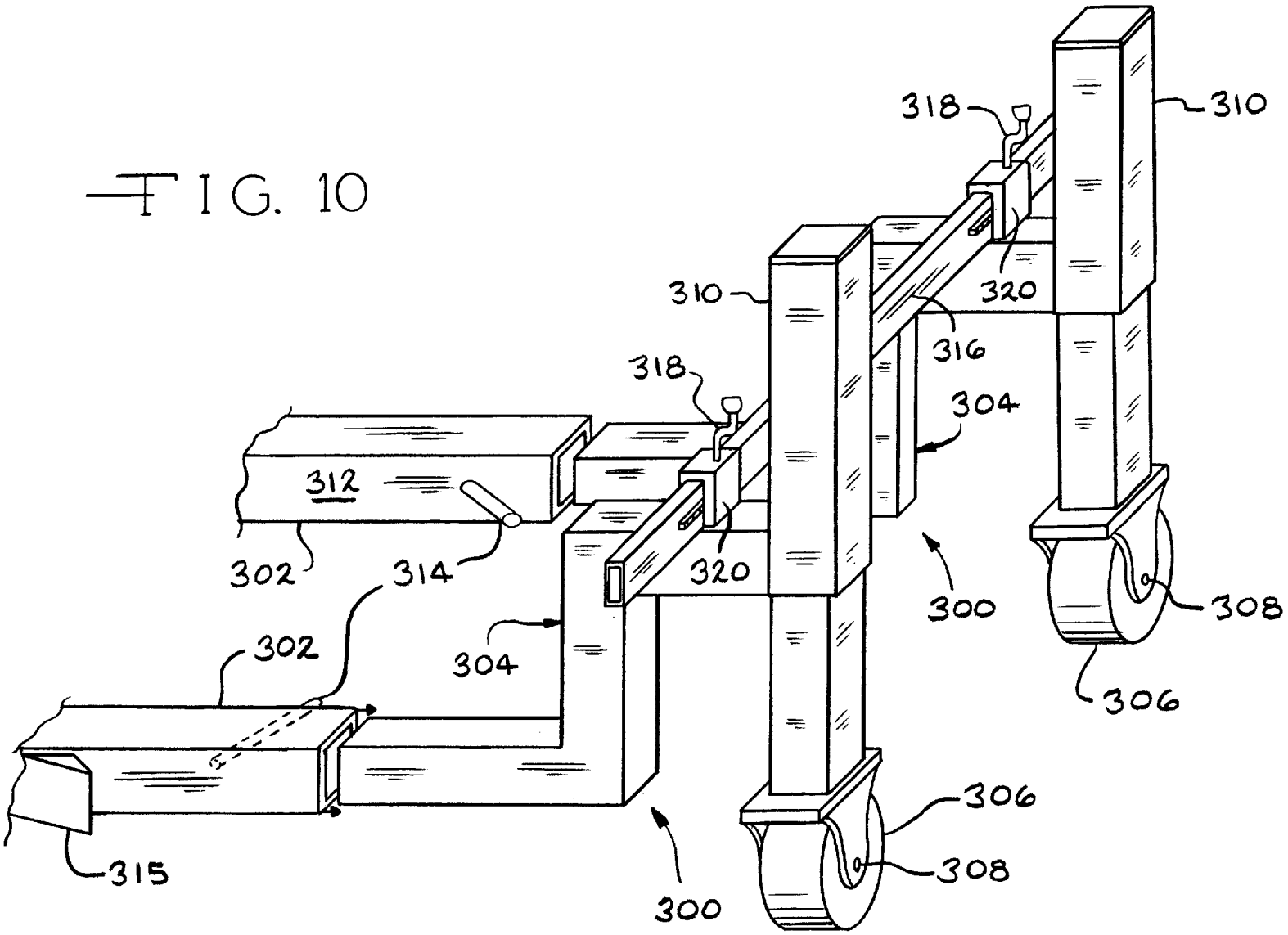
FIG. 10 is a perspective view of a portion of two devices, according to the present invention, with a stabilizer bar connected to them and connecting them to each other.

Referring now to FIG. 10, portions of a pair of devices according to the invention are illustrated. The devices, indicated generally at 400, comprise frames, portions of which are indicated at 302 and frame lifters 304 which are quite similar to the frame lifter mechanism 240 (FIGS. 6 and 7). The frame lifters 304 comprise wheel members 306 supported on axles 308 which, in turn, are supported in housings 310. In a fashion described above, the frame members 302 would be secured to a load (not shown) by engaging an apertured rail secured to the bottom of the load or a portion of the load itself, between a rail or load face 312 of the frame members, on the one hand, and jaws 314 or jaws 315, so that the frame member and, particularly, the rail or load face 312 of the frame member is secured to the rails or directly to a lower edge of the load. The frame member 302 is especially versatile because it has a rod shaped jaw 314 on one face and a slot engaging jaw 315 on an opposite face. Thus, the frame member is reversible so that either the jaw 314, suited for lifting lug apertures, or the jaw 315, suitable for fork slots, may be positioned to face a load and used to engage a load and secure it to the frame including frame member 302.

As the frame lifters are operated, as described above, to lower the wheels from a retracted position until they engage a surface under the load and beyond so that the frame is lifted, there is a tendency for the frame lifters to twist so that the housings 310, for example, would be moved closer together than they are in FIG. 10, as indicated by arrows. This twisting is prevented, according to this embodiment, by a stabilizer 316 which is connected, by threaded fasteners 318, within fittings 320 secured to the frame lifters 304. The stabilizer 316, then, is secured to the frame lifters 304 and prevents them from twisting under the weight of the load.

Figure 11:
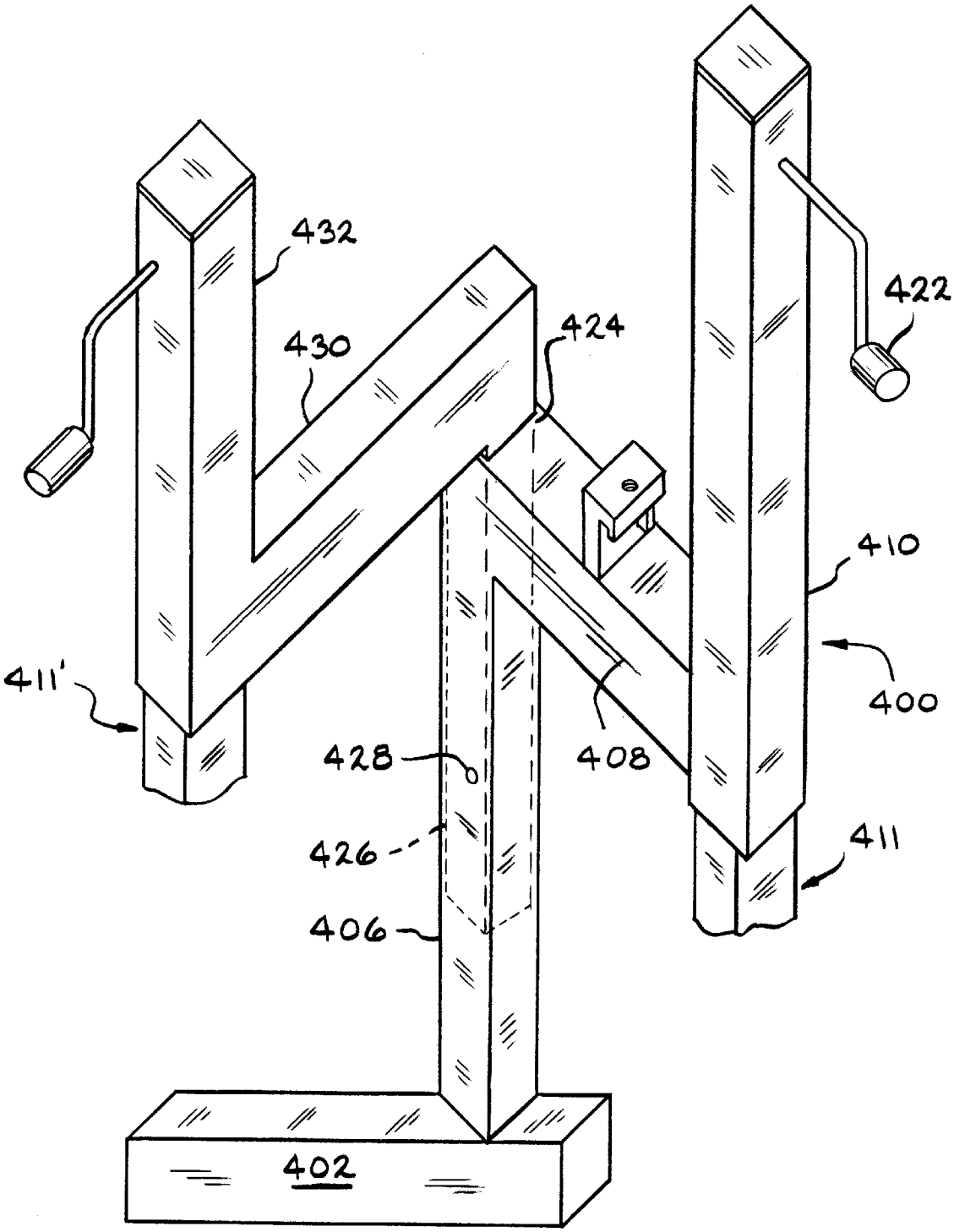
FIG. 11 is a perspective view of a frame lifter which is preferred in many applications.
Figure 12:
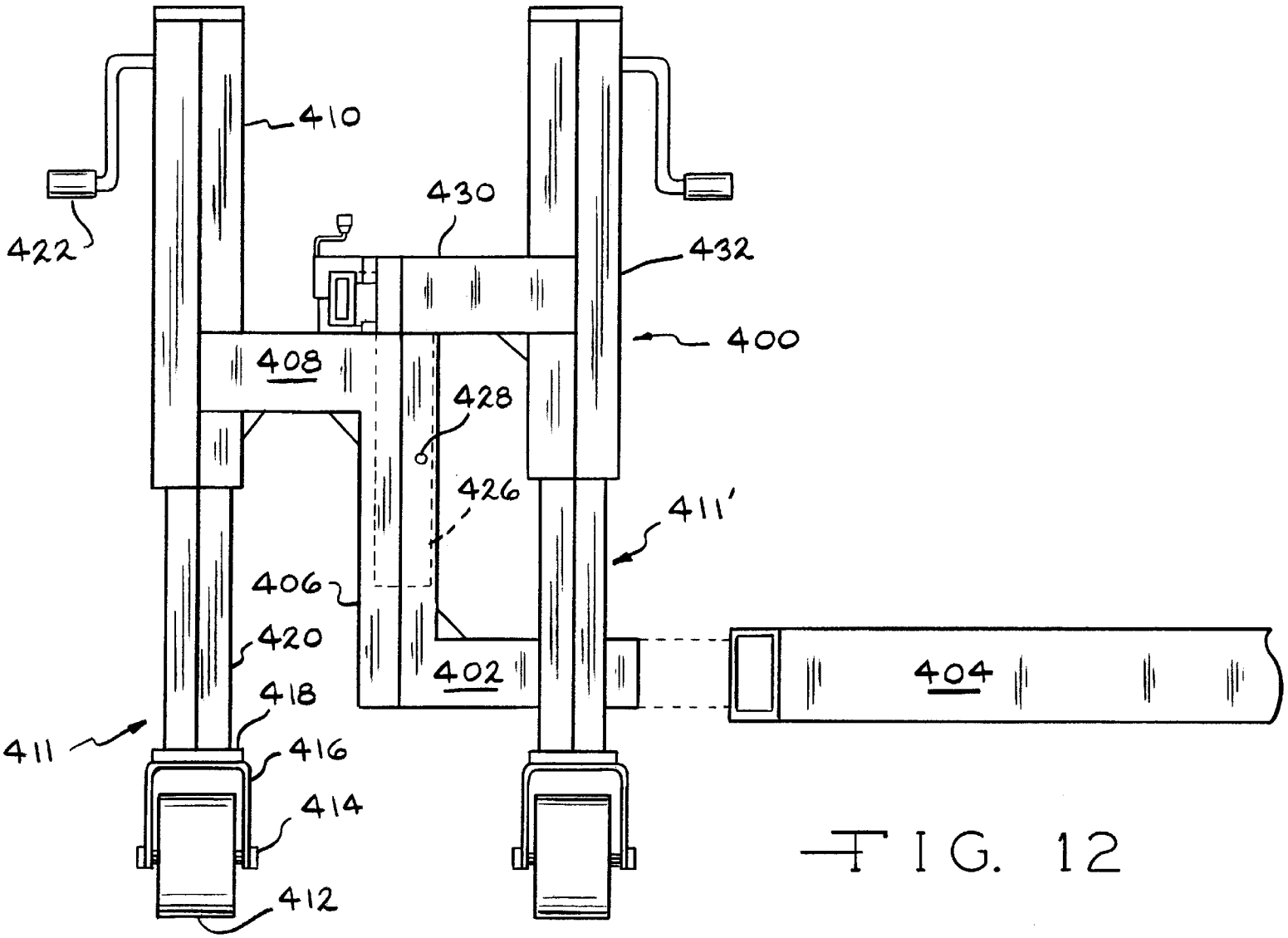
FIG. 12 is an end view of the frame lifter shown in FIG. 11.

Referring now to FIGS. 11 and 12, an especially preferred frame lifter is indicated generally at 400. The lifter 400 comprises a frame engaging member 402 for engaging a frame, a portion of which is indicated at 404 in FIG. 12. Preferably, the frame 404 telescopically receives the frame engaging member 402 or vice versa, although the two could be permanently connected. As disclosed elsewhere, the frame 404 and the frame engaging member 402, if separate, would preferably be pinned, bolted or otherwise releasably secured together.

The lifter 400 further comprises a first riser 406 which is secured to the frame engaging member 402, and extends upwardly therefrom to a first wheel housing support 408 which is connected to a first wheel housing 410. A wheel assembly indicated generally at 411 (FIG. 12) comprises a wheel 412 mounted for rotation about an axle 414 which is secured in an axle bracket 416 which, in turn, is secured to a plate 418 which is supported at one end of a wheel post 418. The wheel 412 and the axle bracket 416 are supported relative to the wheel post 420 so that the may pivot, in known fashion about a longitudinal axis thereof. The wheel post is telescopically slidable inside the first wheel housing 410 and a conventional wheel post positioner (not shown) inside the wheel post 410 cooperates, in known fashion, with a handle 422 so that, when the handle 422 is rotated in a first direction, the wheel post 420 is extended out of the first wheel housing 410 and when the handle 422 is rotated in the opposite direction, the wheel post 420 is drawn into the first wheel housing 410.

As seen in FIG. 11, there is an opening, indicated at 424, at the upper end of the riser 406 so that a supplemental riser 426 may be inserted therethrough and telescopically received inside the riser 406. A pin 428 locks the riser 426 to the riser 406 and prevents them from telescopic movement. The riser 426 is connected to a supplemental wheel housing support 430 which, in turn, is connected to a supplemental wheel housing 432. A supplemental wheel assembly 411', corresponding with the wheel assembly 411, is supported in the supplemental wheel housing 432. In the illustrated embodiment, the wheel housing support 408 and the supplemental wheel housing support 430 are at right angles to each other and each forms about a forty five degree angle with the longitudinal axis of the frame engaging member 402 and the frame 404. These angles may be varied but the preferred angles are illustrated.

The frame lifter 400 may be used together with or without the supplemental riser 426, the supplemental wheel housing support 430, the supplemental wheel housing 432 and the supplemental wheel assembly 411'. When used together, the frame lifter 400 will distribute the weight of the load over more of the surface underneath the load. The supplemental wheel assembly can be inserted and removed, as necessary, to enable a load carried on a device according to the invention, to be moved over an obstacle on the surface under the load, much in the manner described above with reference to FIG. 9.

The apparatus of FIGS. 4 and 5, that of FIGS. 6 and 7, that of FIG. 9, that of FIG. 10, and that of FIGS. 11 and 12 is like that of FIGS. 2 and 3, as described above, in being modular in the sense that it can be disassembled into at least two components for transportation to a new location, and then reassembled for use.

The foregoing description is set forth to enable one skilled in the art to understand and to carry out the invention. Although the invention has been described in terms of specific embodiments, it can be embodied in other ways not shown or discussed which fall, nonetheless, within the spirit and scope of the appended claims.

I claim:

1. A lift device for lifting a load having apertures in a lower portion of the load, said device comprising a frame having first and second ends, said frame comprising first and second load facing surfaces, first and second jaws supported on said frame, said first jaw extending outwardly from said first load facing surface and having a load engaging surface, and said second jaw extending outwardly from said second load facing surface and having a load engaging surface, and a jaw positioner operable to secure said first and second jaws in a position where they lock said frame to the load with said first and second load facing surfaces in contact with the load, with a portion of the load held captive between said first load facing surface and said load engaging surface of said first jaw, and with a portion of the load held captive between said second load facing surface and the load engaging surface of said second jaw, and said device further comprising a first frame lifter and a connector for connecting it to said first end of said frame and a second frame lifter and a connector for connecting it to said second end of said frame, said frame lifters each comprising a wheel supported for reciprocating movement between a first position in which, when said first and second frame lifters are connected to said frame and said frame is locked to the load, said first and second frame lifter wheels are above a surface under the load, and a second position in which, when said first and second frame lifters ire connected to said frame and said frame is locked to the load, said first and second frame lifter wheels engage the surface and support said frame and the load above the surface.

2. The device claimed in claim 1 wherein each of said first and second frame lifters further comprise a threaded wheel positioner operable to move said wheel between said first and second positions.

3. The device claimed in claim 1 wherein said jaw positioner comprises a threaded jaw positioner.

4. The device claimed in claim 1 wherein each of said frame lifters is operable to support a second wheel for reciprocating movement between a first position in which, when the frame lifter is connected to the frame and the frame is connected to the load, said second wheel is above a surface under the load, and a second position in which said second wheel engages the surface and supports the frame above the surface.

5. The lift device claimed in claim 1 wherein said frame further comprises third and fourth load facing surfaces, and third and fourth jaws supported on said frame, said third jaw extending outwardly from said third load facing surface and said fourth jaw extending outwardly from said fourth and facing surface and wherein said jaw positioner is further operable to secure said third and fourth jaws in a position where they lock the frame to the load with said third and fourth load facing surfaces in contact with the load.

6. The lift device claimed in claim 1 wherein said jaw positioner is operable to move said jaws towards each other to the position where they lock said frame to the load.

7. The lift device claimed in claim 1 wherein said jaw positioner is operable to move said jaws away from each other to the position where they lock said frame to the load.

8. The lift device claimed in claim 1 wherein at least one of said frame and said frame lifter is modular in the sense that it is composed of at least two components which are releasably engaged with one another and can be disassembled into at least two components for transportation.

9. The lift device claimed in claim 8 wherein both of said frame and said frame lifter are modular in the sense that they are composed of at least two components which are releasably engaged with one another and can be disassembled into at least two components for transportation.

* * * * *